US010160111B2

(12) United States Patent
Blickle et al.

(10) Patent No.: US 10,160,111 B2
(45) Date of Patent: Dec. 25, 2018

(54) MACHINE TOOL THAT CAN BE GUIDED MANUALLY AND HAVING A HOUSING

(71) Applicant: C. & E. FEIN GMBH, Schwäbisch Gmünd-Bargau (DE)

(72) Inventors: Jürgen Blickle, Göppingen (DE); Uwe Früh, Sonnenbühl (DE); Achim Hess, Korb (DE)

(73) Assignee: C. & E. FEIN GMBH, Schwäbisch Gmünd-Bargau (DE)

( * ) Notice: Subject to any disclaimer, the term of this patent is extended or adjusted under 35 U.S.C. 154(b) by 590 days.

(21) Appl. No.: 14/394,180

(22) PCT Filed: Apr. 22, 2013

(86) PCT No.: PCT/EP2013/001206

§ 371 (c)(1),
(2) Date: Oct. 13, 2014

(87) PCT Pub. No.: WO2013/159903

PCT Pub. Date: Oct. 31, 2013

(65) Prior Publication Data

US 2015/0144367 A1 May 28, 2015

(30) Foreign Application Priority Data

Apr. 24, 2012 (DE) ..... 10 2012 103 604

(51) Int. Cl.
*B25F 5/00* (2006.01)
*B25D 17/24* (2006.01)
*B25F 5/02* (2006.01)

(52) U.S. Cl.
CPC ..... *B25F 5/006* (2013.01); *B25F 5/001* (2013.01); *B25F 5/02* (2013.01)

(58) Field of Classification Search
CPC . B25F 5/001; B25F 5/006; B25F 5/02; B25D 17/24

(Continued)

(56) References Cited

U.S. PATENT DOCUMENTS 2,341,497 A * 2/1944 Amtsberg ..... B25B 21/026 173/210
3,794,124 A * 2/1974 Biersack ..... B23B 45/008 173/104

(Continued)

FOREIGN PATENT DOCUMENTS

CN 201271828 Y 7/2009
CN 101970183 A 2/2011

(Continued)

OTHER PUBLICATIONS

Chinese Office Action for Chinese Application No. 201380021580.6 dated Jul. 13, 2015.
International Search Report.

*Primary Examiner* — Gloria R Weeks
(74) *Attorney, Agent, or Firm* — Benesch Friedlander Coplan & Aronoff LLP

(57) ABSTRACT

A machine tool that can be guided manually has an outer housing that extends along a longitudinal axis and has a hand grip region. An electrical drive unit and a tool unit are accommodated in the outer housing and are mechanically uncoupled relative to the outer housing. The outer housing has a center of mass that, with respect to the length of the outer housing, is arranged along the longitudinal axis in a section that extends toward the rear from the geometric center of the outer housing.

8 Claims, 3 Drawing Sheets

Figure 1:
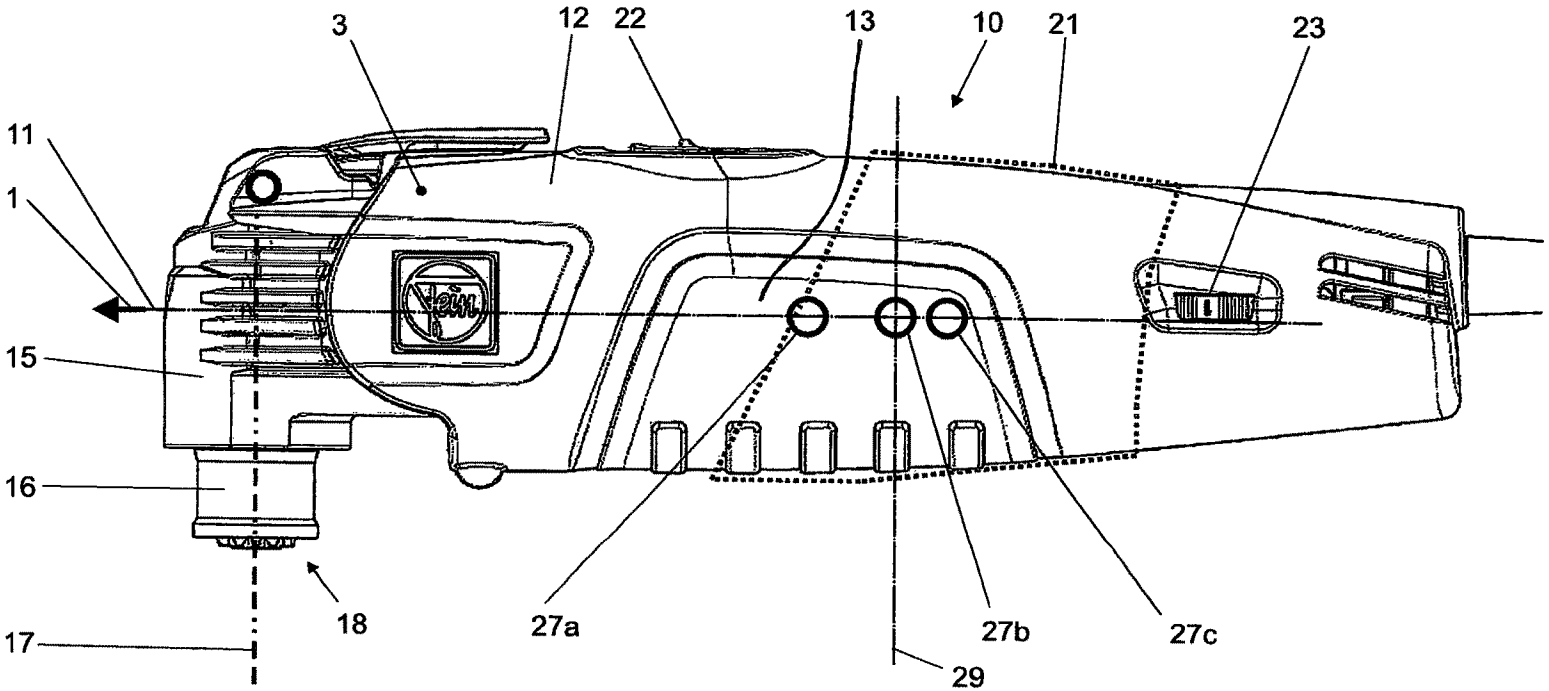

(58) Field of Classification Search
USPC ..... 173/100, 162.1, 162.2, 210
See application file for complete search history.

(56) References Cited

U.S. PATENT DOCUMENTS 4,217,677 A * 8/1980 Sumikawa ..... B25F 5/006 16/431
4,635,732 A * 1/1987 Gotsch ..... B25F 5/001 173/162.1
4,747,455 A * 5/1988 Cunningham ..... B25C 1/06 173/1
4,879,847 A * 11/1989 Butzen ..... B25F 5/006 173/162.2
4,905,772 A * 3/1990 Honsa ..... B24B 23/02 173/162.1
4,936,394 A * 6/1990 Ohtsu ..... B24B 23/005 173/162.2
5,394,039 A * 2/1995 Suchdev ..... H02K 5/24 173/162.2
5,533,579 A * 7/1996 Chu ..... B25D 9/08 173/13
5,533,704 A * 7/1996 Fischinger ..... F04D 29/668 248/603
5,692,574 A * 12/1997 Terada ..... B25F 5/006 173/162.2
5,769,508 A * 6/1998 Gilles ..... B60T 8/368 303/116.4
5,875,562 A * 3/1999 Fogarty ..... A45D 20/10 34/97
6,068,067 A * 5/2000 Kettner ..... B25B 21/02 173/162.1
6,286,610 B1 * 9/2001 Berger ..... B25D 17/24 173/162.1
6,329,730 B1 * 12/2001 Neckermann ..... F04D 29/668 310/43
6,394,191 B1 * 5/2002 Nakane ..... B25F 5/00 173/217
6,550,145 B2 * 4/2003 Stoll ..... B25F 5/006 173/162.1
6,763,897 B2 * 7/2004 Hanke ..... B25D 17/24 173/162.2
6,779,699 B2 * 8/2004 Aoki ..... B25C 1/047 173/210
7,048,075 B2 * 5/2006 Saito ..... B25B 21/02 173/178
7,152,695 B2 * 12/2006 Happ ..... B25F 5/006 173/162.1
7,721,818 B2 * 5/2010 Inagawa ..... B24B 23/028 173/162.1
7,794,308 B2 * 9/2010 Wuensch ..... B24B 23/00 173/162.2
7,866,412 B2 * 1/2011 Avis ..... B25D 17/24 173/162.1
7,896,103 B2 * 3/2011 Johnson ..... B25F 5/006 173/162.1
7,921,934 B2 * 4/2011 Aoki ..... B25D 16/00 173/162.1
7,950,471 B2 * 5/2011 Loeffler ..... B25D 11/005 173/104
8,038,133 B2 * 10/2011 McPherson ..... F16L 9/21 173/162.2
8,074,734 B2 * 12/2011 Gumpert ..... B25D 17/24 173/162.1
8,196,674 B2 * 6/2012 Ikuta ..... B25D 17/24 173/162.1
8,573,323 B2 * 11/2013 Muller ..... A01D 34/902 173/171
8,590,633 B2 * 11/2013 Berghauser ..... B25D 17/06 173/109
8,596,427 B2 * 12/2013 Numata ..... B24B 23/028 171/141
8,672,305 B2 * 3/2014 Wolf ..... B25F 5/006 173/162.2
8,714,280 B2 * 5/2014 Moreno ..... B25D 17/043 173/162.2
9,016,672 B2 * 4/2015 Englund ..... B25F 5/006 173/162.2
9,234,979 B2 * 1/2016 Bolbocianu ..... G01V 3/02
9,434,062 B2 * 9/2016 Kamegai ..... B25D 17/24
9,475,180 B2 * 10/2016 Eshleman ..... B25B 21/004
9,545,713 B2 * 1/2017 Johnson ..... B25F 5/006
9,641,046 B2 * 5/2017 Christen ..... B24B 23/04
2002/0079420 A1 * 6/2002 Arnold ..... F16M 1/00 248/672
2002/0096341 A1 * 7/2002 Hagan ..... B25B 21/00 173/170
2004/0206523 A1 * 10/2004 Giardino ..... B25B 23/1405 173/176
2006/0162943 A1 * 7/2006 Stirm ..... B25D 11/106 173/114
2007/0034398 A1 * 2/2007 Murakami ..... B25B 21/02 173/210
2008/0115952 A1 * 5/2008 Vogele ..... B25D 11/125 173/109
2008/0196913 A1 * 8/2008 Bram ..... B25D 17/043 173/162.2
2008/0202784 A1 * 8/2008 Stierle ..... B25F 5/006 173/162.1
2008/0223594 A1 * 9/2008 Eisenhardt ..... B25F 5/006 173/162.2
2009/0194306 A1 8/2009 Johnson et al.
2010/0068977 A1 * 3/2010 Zhang ..... B25F 5/006 451/357
2010/0206596 A1 * 8/2010 Kamegai ..... B23D 51/01 173/162.2
2010/0209280 A1 * 8/2010 Flannigan ..... F04C 18/16 418/201.2
2011/0100665 A1 * 5/2011 Nakashima ..... B23D 51/01 173/162.2
2011/0248583 A1 * 10/2011 O'Banion ..... B25B 21/00 310/50
2012/0031638 A1 * 2/2012 Kamegai ..... B25D 17/245 173/162.2
2012/0037391 A1 * 2/2012 Clabunde ..... B23Q 11/0032 173/162.1
2012/0118598 A1 * 5/2012 Iio ..... B25D 17/24 173/162.1
2012/0129435 A1 * 5/2012 Ikuta ..... B25F 5/006 451/358
2012/0298392 A1 * 11/2012 Weiss ..... F16F 7/10 173/162.2
2012/0305277 A1 * 12/2012 Ikuta ..... B25D 17/24 173/162.1
2013/0209017 A1 * 8/2013 Schadow ..... B24B 23/028 384/536
2014/0326477 A1 * 11/2014 Thorson ..... B23Q 11/0032 173/171

FOREIGN PATENT DOCUMENTS

DE 4000861 A1 7/1991
DE 19730356 A1 1/1999
DE 202005020647 U1 6/2006
DE 102010042605 A1 4/2012
EP 1752259 2/2007
EP 2213417 A2 1/2010

* cited by examiner

MACHINE TOOL THAT CAN BE GUIDED MANUALLY AND HAVING A HOUSING

The present invention concerns a handheld machine tool, particularly a handheld oscillation machine tool having an outer housing extending essentially along a longitudinal axis and having a gripping region which is provided for engaging and for guiding the machine tool by means of a hand of a user.

From the state of the art, handheld machine tools are known, whose housings are either fixedly screwed to the drive units of the machine tool or comprise housings, which consist of shell components, mostly half-shells, fixedly connected to each other. In order to facilitate good guidance of the handheld machine tools during processing of work pieces, the housings of machine tools known in the state of the art at least section-wise rests against the elements of the drive arrangement, wherein vibrations from these drive arrangements are directly transmitted to the housing, which thus vibrates with the drive arrangements, whereby work safety and handling comfort of such a machine tool is affected.

Hence, the underlying task of the invention is providing a handheld machine tool with an improved handling comfort.

According to the invention, this is attained by the teaching of the independent claims. Preferable embodiments of the invention are subject of the dependent claims.

A handheld machine tool according to the invention can particularly also be a handheld oscillation machine tool. Such a handheld machine tool comprises an outer housing extending essentially along a longitudinal axis and having a gripping region which is provided for engaging and for guiding the machine tool by means of a hand of a user. Essentially within this outer housing, an electric drive unit is accommodated, which rotatively drives a drive shaft of the machine tool. Thereby, the axis of rotation of the drive shaft is aligned essentially parallel to a longitudinal axis of the outer housing or can also coincide with said longitudinal axis. At a first ending of the electric drive unit, a tool arrangement is arranged, which is arranged in a first end portion of the outer housing.

The tool arrangement serves for transmission of the drive torque of the electric drive unit to a tool preferably arranged at the tool arrangement. For transmission of drive power of the electric drive unit to a tool, the tool arrangement can comprise several elements like gear boxes, couplings, and similar. Thereby, the electric drive unit as well as the tool unit can be formed from several parts. Preferably, the machine tool comprises a tool holder at the end of the tool arrangement opposing the electric drive unit, wherein the drive axis of the tool holder can also be arranged angularly deviated with respect to the drive axis of the electric drive element. Generally, the tool holder can be arranged at an outer end of the drive axis, it can, however, also be arranged at an area spaced from the end of the tool arrangement. Exemplarily, the tool holder can also be arranged within a recess in the area of a drive shaft in which the tool can be inserted. The tools employable with the machine tool particularly serve for cutting, drilling, grinding, sowing, grating or for other cutting, abrasive or forming processing steps. By the drive and processing operations at the processing tool and by the inertia of the processing tool arranged at the tool arrangement, vibration and blows occur at the tool arrangement.

The electric drive unit and the tool arrangement, in which there is active drive shaft rotation during the operation of the tool machine, are charged with blows and vibrations resulting from the drive of the tool, the tool movement and the processing step at the tool fixed to the drive shaft. The drive arrangements of the handheld machine tool are essentially mechanically decoupled with respect to the outer housing. Thereby, a direct transmission of movements of the drive arrangements to the outer housing guided by the user is essentially interrupted. With respect to the invention, mechanically decoupled means that the electric drive unit is arranged widely movable with respect to the outer housing. That means that no essential mechanical transmission of the movements of the drive arrangements to the outer housing takes place, but particularly only a dampened transmission of a rest vibration, particularly of higher frequent oscillation in at least one effective direction, preferably in two, and especially preferably no substantial transmission in one of the three spatial directions. The outer housing of the handheld machine tool already therefrom comprises improved handling comfort compared to an outer housing mechanically coupled to the drive elements.

The outer housing of the handheld machine tool comprises a mass center. Said mass center is arranged along the longitudinal axis in a section essentially extending from the geometric center of the outer housing into a direction remote from the first end portion with respect to the length of the outer housing, thus preferably extending to the rear. Preferably, approximately in the area of the geometric center of the outer housing—also seen with respect to the longitudinal axis—lies a front section of the gripping region, in which the user engages and guides the handheld machine tool. Further preferably, a gripping arrangement is arranged at the outer housing in the section in which the gripping region is located, wherein the gripping arrangement, particularly a rubber coating and/or a recessed grip, supports the user in engaging and guiding the machine tool. Thereby, a gripping arrangement can be arranged completely within the gripping region, but it can particularly also be arranged only at a part of the gripping region and/or protrude therefrom for ergonomic or aesthetic reasons.

In an item stimulated by oscillation, the amplitude of the oscillation normally is lowest at the mass center. Thus, for example, vibrations of the outer housing of a machine tool in the area of its mass center have a lesser effect than at areas of the outer housing more distant from the mass center. If the mass center of an outer housing mechanically decoupled from the drive arrangements lies within an area extending from the geometric center of the outer housing to a direction remote from the first end portion, said mass center lies within the gripping region of the user. Due to the arrangement of the gripping region thereby advantageous regarding oscillation, handling comfort of the handheld machine tool is improved.

In a preferred embodiment the tool arrangement is essentially rigidly coupled to the electric drive unit. The tool arrangement thereby can be arranged directly at a first ending of the electric drive unit. Similarly, it is also possible that the tool arrangement is connected to the electric drive unit indirectly, exemplarily by an interposition of a different arrangement, as exemplarily a fan arrangement, wherein the electric drive unit is preferably similarly essentially rigidly coupled to the electric drive unit. In the context of the present invention, "rigidly coupled" means that these arrangements are mechanically coupled, whereby movement, also of the high frequency type, as exemplarily vibrations, can be transmitted from one to the other element independently from the effective direction of these vibrations. A rigid connection or coupling, respectively, can thus also be carried out by means of an integral construction or similar.

Generally, an item comprising a larger mass will be less stimulated for oscillation or vibration, respectively, than an item with a smaller mass, having the same stimulus. In the same way, also the effect of blows is lesser to a rigid item of greater mass than to a rigid item of smaller mass. Thus, in a preferred embodiment, the arrangements of the machine tool which are preferably not mechanically coupled to the drive arrangements as particularly the electric drive unit or the tool arrangement for performing their function are arranged movable with respect to these and thereby are arranged mechanically decoupled at the outer housing of the machine tool. So the mass of the outer housing is increased by the masses of these arrangements and thereby the predisposition for oscillation of the outer housing is decreased. For an arrangement at the outer housing, particularly operation arrangements of the machine tool as on/off switches, power controllers or other setting arrangements, which are in any case arranged in the area of the outer housing, are to be considered. Preferably, control arrangements of the machine tool particularly arranged within the outer housing as particularly the drive motor control or the fan control are also mechanically coupled. Beneath the increase of the mass of the outer housing, particularly the vibration load of the control arrangement decreases, which result in a larger live span and a lower error proneness of the control arrangement. Additionally, thereby the mass center of the outer housing is displaced from the geometric center of the outer housing into a direction remote from the first end portion of this geometric center insofar as these arrangements are arranged in the, particularly rear, area of the machine tool remote from the first end portion.

In a further preferred embodiment, at least one support arrangement of the handheld machine tool, particularly an arrangement for supply of electric current, is mechanically coupled to the outer housing. An arrangement for supply of an electric current to the drive arrangement of the machine tool can particularly be a supply line applying of a line current as well as a connection of such a supply line to the housing. Similarly, a supply arrangement of the machine tool can be a, particularly independent, arrangement for initialization of electric energy, which particularly stores electric energy, as a primary or secondary battery, or stores chemical energy and converts it by means of an energy converter into electrical energy and, particularly, dispenses this electrical energy to the electric drive unit. Preferably, these supply arrangements are arranged behind the electric drive unit in a direction remote from the first end portion of the outer housing and thus are preferably located behind the gripping region of the outer housing in or from the geometric center of the outer housing. So, on the one hand, the mass of the outer housing is increased by the mass of these supply arrangements and thus, as well the predisposition for oscillation of the outer housing is decreased as the mass center of the outer housing is shifted towards a direction remote from the first end portion.

Hence, it is especially preferred, when the arrangements as particularly the at least one operation arrangement, the at least one control arrangement and/or the at least one supply arrangement mechanically coupled to the outer housing, are essentially mechanically decoupled with respect to the electric drive arrangement. Thereby, these arrangements preferably transmit no additional movement from the electric drive unit or the tool arrangement to the outer housing.

In a further preferred embodiment, in order to increase the mass of the outer housing of the machine tool, an auxiliary mass is arranged at the outer housing. Therein, particularly the outer housing itself can be formed heavier, i.e. comprise a greater mass. For this purpose, an embodiment with larger wall thickness or with a material with a higher specific density or a higher specific weight than required for reasons of stability can be provided in such areas, in which an increase in mass results in a shift of the mass center of the outer housing towards a section which is arranged from the geometric center of the outer housing towards a direction remote from the first end portion. Equally, it is preferred to arrange an auxiliary mass particularly in the interior of the outer housing or, insofar as it is advantageous from a design point of view or ergonomically advantageous, also outside of the outer housing.

In a preferred embodiment, the mass center of the outer housing is with respect to the total length of the outer housing arranged at a portion which extends into a direction remote from the first end portion of the outer housing as far as a distance that corresponds to 20% of the total length of the outer housing, which particularly extends as far a distance that corresponds 10% of the total length of the outer housing and which especially preferably is arranged at a distance of approximately 7% from the geometric center of the outer housing. For an outer housing having a length of 220 mm, wherein the mass center preferably is arranged at a distance of 15 mm from the geometric center of the outer housing in a direction remote from the first end portion.

In a preferred embodiment, the outer housing of the handheld machine tool comprises a defined inner contour. Accordingly, the electric drive unit and the tool arrangement preferably essentially rigidly coupled to said drive unit comprise a preferred defined outer contour, wherein the tool arrangement comprises a defined outer contour at least insofar as it is arranged in the area of the outer housing. As far as between the electric drive unit and the tool arrangement, further arrangements are arranged, whose outer contour extends between the electric drive unit and the tool arrangement, these arrangements preferably equally constitute a part of the defined outer contour without subsequently being explicitly mentioned, respectively. The outer contours of these drive elements and the inner contour of the outer housing are preferably formed such that they are at a predetermined minimum spacing from one another. This minimum spacing and the air layer thereby lying between the outer contour and the inner contour result in a mechanical decoupling of the electric drive unit as well as of a tool arrangement from the outer housing and thereby in an increased handling comfort. Additionally, a reduction of the heat transmitted from the drive unit and from the tool arrangement to the housing results from the minimum spacing, equally increasing handling comfort for the user.

For adherence of this minimum spacing, preferably a number N of first support devices is provided at the outer contour of electric drive unit and tool arrangement and a number N of second support devices is provided at the inner contour of the outer housing. The first support devices and the second support devices thereby preferably cooperate such that they keep the outer contour and the inner contour at this minimum spacing from each other.

By the cooperation of the first and second support devices the inner contour and thereby the outer contour and, particularly, the gripping region of the handheld machine tool are kept at a distance from the outer contour and thereby at a distance from the electric drive unit and the tool arrangement.

In a further preferred embodiment, between a first support device and a second support device, at least one damping element is arranged, respectively, which transmits the support forces between a first and a second support device and at the same time keeps the minimum spacing between the outer contour and the inner contour. The first and the second support devices thus facilitate a sufficient transmission of support forces as the guiding forces from the user to the machine tool and the processing forces from the tool to the user. By the arrangement of such a damping element, the transmitted movements as particularly blows or vibrations are damped particularly between the first and second support devices. Thereby, particularly, the transmission of higher frequency oscillation as vibrations is interrupted. Thus, the transmission of vibration, blows and heat of the drive elements to the housing is reduced, whereby work safety and handling comfort of the machine tool significantly improves.

A damping element adapted for this purpose is on the one hand elastically deformable, but on the other hand opposes an inner friction resistance to the deformation resulting in a damping. In combination with a suitable design of the first and second support devices, the support forces between the first and second support devices are transmitted by the power transmission elements arranged in between, preferably predominantly by means of a frictional connection. Herefrom results a mechanical decoupling of the drive elements with respect to the outer housing.

The defined inner contour of the outer housing preferably at least area-wise follows the defined outer contour of electric drive arrangement and—insofar the outer housing surrounds it—the tool arrangement. Thereby, the outer contour and the inner contour with an exception of the areas of the first and the second support devices comprise a minimum spacing from one another, which preferably amounts to between 1 mm and 3 mm.

At the outer contour of the drive elements, preferably a number N of first support devices is arranged and at the inner contour of the outer housing, a number N of second support devices is arranged. Thereby, a first support device preferably in combination with a damping element cooperates with a second support device, respectively, such that the outer contour and the inner contour comprise a predetermined minimum spacing from one another at every position—apart from the first and second support devices. The number N results particularly from the design of the first and the second support devices. The geometric design of the outer contour of the electric drive unit and the tool arrangement as well as the geometric design of the outer housing have further influence on the number N of support devices.

It is generally preferred that a first support device, respectively, preferably in combination with a damping element, cooperates with a second support device and thereby forms an arrangement of first and second support device. Thereby, a number N of effective first support devices at the drive elements preferably corresponds to the number N of effective second support devices at the outer housing.

The second support devices are further preferably arranged outside the gripping region at the outer housing. The inner contour of the outer housing is thereby arranged in the gripping region at a minimum spacing from the outer contour of the drive elements of the machine tool and can move preferably according to the elasticity of the outer housing in this area with respect to the outer contour, whereby additionally a certain mechanical decoupling of the gripping region from the drive elements results. This equally contributes to improved handling comfort of the machine tool.

In a preferred embodiment of the machine tool, at least two arrangements of first and second support devices are arranged spaced apart from each other as far as possible. Thereby, preferably at least one arrangement of a first and second support device is arranged at the tool arrangement and at least another arrangement of a first and second support device is arranged at the end of the electric drive unit opposing the tool arrangement. By means of the at least one arrangement of first and second support device at the tool arrangement, a good guidance of the machine tool by the user is facilitated. The at least one arrangement of first and second support device at the end of the electric drive unit opposing the tool arrangement facilitates a sufficient connection of the electric drive unit with the outer housing and thereby in connection with the arrangement of the first and second support devices at the tool arrangement a sufficient transmission of guiding forces of the user to the drive arrangements of the machine tool. Additionally, such a design leads to a far going mechanical decoupling of the gripping region with respect to the vibration and blows at the drive arrangements in connection with the elasticity of the outer housing, particularly when the opposing end of the electric drive unit lies outside of the gripping region of the outer housing.

In a further preferred embodiment, the outer housing is formed from at least two shell components. Therein, the parting line of at least two shell components of the outer housing preferably runs at least partially in a direction orthogonal to at least one effective axis of at least one, particularly two arrangements of first and second support devices, so that forces which oppose the assembly of the outer housing are supported. Therein, the at least two shell components of the outer housing are preferably connected to each other in an area in which at least a second support device is arranged, in the direction of the drive axis positively and/or frictional, preferably by means of a screw connection.

Further advantages, features and applications of the present invention result from the following description in connection with the Figures.

It is shown in

Figure 2:
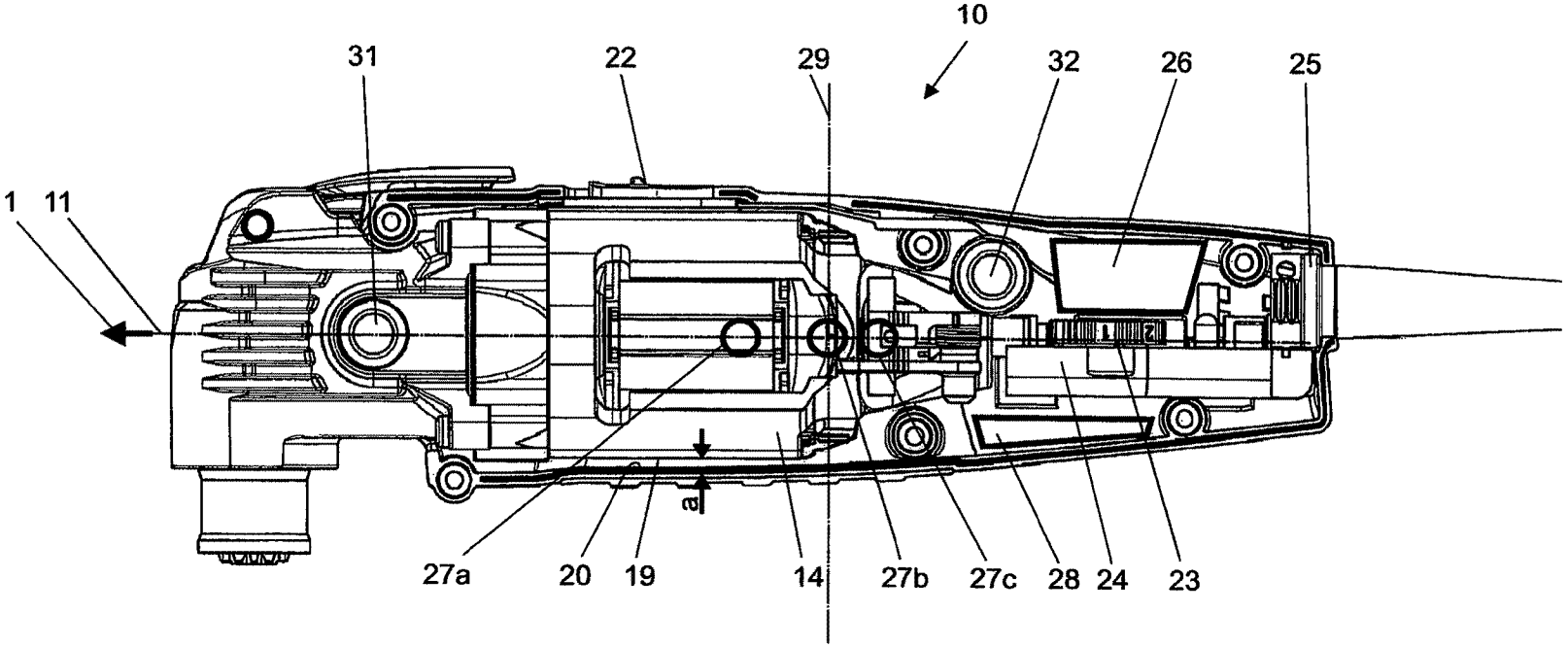
Figure 3:
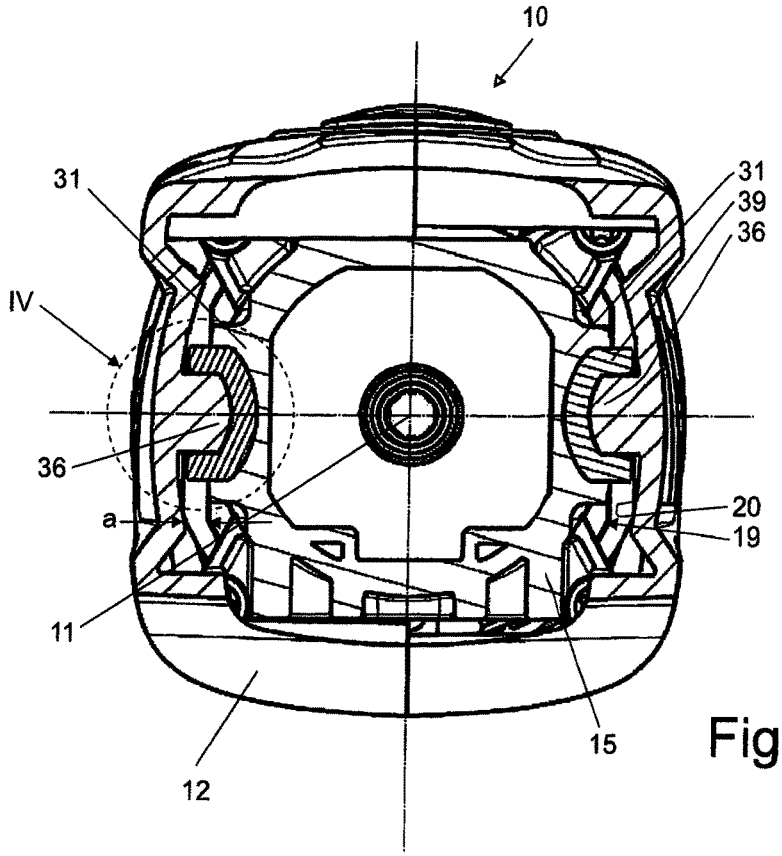

FIG. 1: an exemplary handheld machine tool according to the present invention;

FIG. 2: the exemplary handheld machine tool from FIG. 1 without the front outer housing half-shell;

FIG. 3: a vertical cross-section through an exemplary machine tool; and

Figure 4:
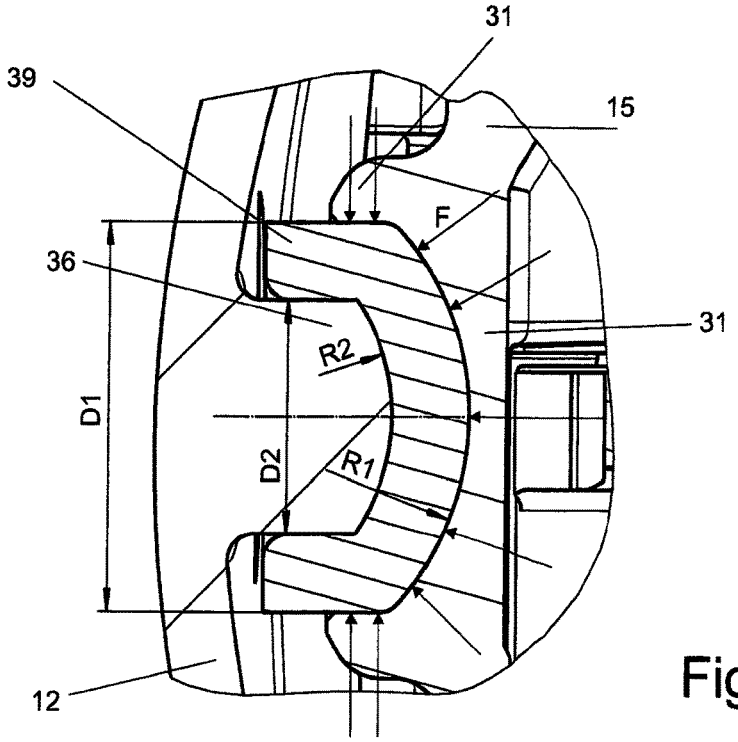

FIG. 4: an enlarged view of a cross-section through an arrangement of first and second support devices according to the detail IV as drawn in in FIG. 3.

FIG. 1 shows and exemplary handheld machine tool 10 according to the present invention, which is carried out as an oscillation machine tool in the exemplary embodiment. Outer housing 12 comprises a defined inner contour and comprises two housing halves. Furthermore, outer housing 12 comprises a grip arrangement 13 arranged at the outer housing as well as a gripping region 21 drawn in in a broken line, which the user engages during operation of the machine tool. Outer housing 12 surrounds an electric drive arrangement driving the machine tool as well as an area of the tool arrangement 15, which is arranged in a first end portion 3 of outer housing 12. Tool arrangement 15 comprises a drive shaft 16 oscillatory driven around a drive axis 17, wherein the drive axis 17 is arranged downwardly deviated by 90° with respect to the axis of rotation of the electric drive arrangement, which coincides with a longitudinal axis 11 of the machine tool in the exemplary embodiment. At the end of drive shaft 16, a tool holder 18 for holding the suitable processing tool is arranged.

Mass center 27 of outer housing 12 for a housing design as it is exemplarily depicted in FIG. 1, is approximately in the area of the marker of mass center 27*a*. In the upper area of the exemplary handheld machine tool 10, an on/off switch 22 arranged at outer housing 12 is arranged and an output controller 23 arranged at outer housing 12 is arranged at the second end portion of tool machine 10, which opposes tool arrangement 15. The on/off switch 22 as well as the output controller 23 are fixedly connected to outer housing 12 and thereby increase the mass of outer housing 12. Additionally, the masses of on/off switch 22 as well as of output controller 23 shift mass center 27 of outer housing 12 towards the rear along a longitudinal axis 11 of the tool machine into the direction of the second end portion, which lies in a direction remote from the first end portion. A second mass center 27*b* of outer housing 12 is depicted in the area of geometric center 29 of outer housing 10, wherein the geometric center 29 is depicted by axis 29 in FIG. 1. The optimum mass center 27 of exemplarily depicted outer housing 12 lies approximately central in gripping region 21 of machine tool 10 and is suggested by the depicted mass center 27*c*.

FIG. 2 shows the exemplary handheld machine tool 10 from FIG. 1, wherein the front half shell of outer housing 12 is not depicted. The drive elements of tool machine 10, particularly electric drive unit 14 as well as tool arrangement 15 fixed thereto forming a largely rigid unit are recognizable from this representation. The axis of rotation of electric drive arrangement 14 coincides with the longitudinal axis 11 of handheld machine tool 10.

Electric drive unit 14 and toll arrangement 15 comprise a defined outer contour 19 insofar as they are arranged in the area of outer housing 12. In this representation it is equally recognizable that the boundary of the rear half shell, which forms the parting line of outer housing 12 and thereby also a part of inner contour 20 of outer housing 12, is arranged at a distance a from the drive elements of a tool machine 10. Equally well recognizable are the housing connection positions arranged at the half shell, wherein at the housing connection positions the both half shells are connected to each other by means of a screw connection.

A first support device 31 is arranged at the tool arrangement 15 in the area in which the tool arrangement 15 is accommodated in outer housing 12. A further first support device 31 is arranged in the rear area of electric drive unit 14. At the same position, first support devices 31 are equally arranged on the hidden, opposing side of tool arrangement 15 and of electric drive unit 14. Thereby, in front of gripping region 21, two first support devices 31 are arranged, respectively, at the position of the axis of rotation of electric drive unit 14, which serve for transmission of the supporting forces from tool arrangement 15 to outer housing 12. Two first support devices 31 are equally arranged behind gripping region 21 at a distance from longitudinal axis 11 at the side of electric drive unit 14 that opposes tool arrangement 15. Thereby, also behind gripping region 21, two first support devices 31 are arranged, which serve for transmission of support forces from electric drive arrangement 14 to the outer housing 12. At the both housing halves, two second support devices 36 are arranged, which cooperate with the first support devices 31 in order to keep the outer contour and the inner contour at a distance a which corresponds at least to the minimum spacing a.

Between the first support devices 31 and the second support devices 36 at the outer housing 12, damping elements 39 are arranged, whereby the transmission particularly of supporting forces and vibration particularly by inner frictional forces of the damping element is mechanically essentially decoupled. By this construction, the supporting forces of the handheld machine tool 10 are supported by way of the first and second support devices 31, 36 with respect to outer housing 12, wherein said outer housing 12 in connection with minimum spacing a is largely decoupled from electric drive unit 14 and tool arrangement 15, particularly with respect to vibration and blows of said arrangements.

Further, in FIG. 2 a control arrangement 24 is depicted, which is arranged in the rear area of outer housing 12 of machine tool 10. A control arrangement 24 is mechanically decoupled with respect to electric drive arrangement 14 as well as tool arrangement 15 and is arranged at outer housing 12 of machine tool 10. The mass of control arrangement 24 thereby increases the mass of outer housing 12 and thereby decreases the predisposition for oscillation of outer housing 12. Also the supply arrangement 25, which is depicted by supply line in this exemplary embodiment, is mechanically decoupled with respect to drive elements 14, 15 of tool machine 10 and fixedly connected to outer housing 12 of machine tool 10. The auxiliary masses of control arrangement 24 as well as supply arrangement 25, which are arranged at the rear area of outer housing 12, shift mass center 27 of outer housing 12 along longitudinal axis 11 into a direction remote from first end portion 3 in the depicted exemplary embodiment. Said mass center 27 therewith lies approximately at the geometric center 29 of machine tool 10 approximately in the area of the marker of mass center 27*b* and therewith in the front area of gripping region 21.

Additional to these arrangements of machine tool 10, in the rear area of the exemplary embodiment, two auxiliary masses 26 and 28 are arranged at outer housing 12, which reduce the predisposition for oscillation of the outer housing for the reason of additional masses prone to oscillation. Furthermore, since they are arranged in the rear area of outer housing 12, these additional masses 26 and 28 shift mass center 27 of outer housing 12 further along longitudinal axis 11 into a direction remote from the first end portion for about 15 mm beyond the geometric center 29 of outer housing 12 in the depicted exemplary embodiment, approximately in the middle area of gripping region 21. At this position, the marker for mass center 27*c* is depicted in FIG. 1.

FIG. 3 shows a vertical cross-section arranged orthogonal to the axis of rotation of electric drive arrangement 14 through machine tool 10 at the area of support device 31 at tool arrangement 15. Outer housing 12 is thereby covered only in a vertically middle area of the sectional plane. At outer housing 12, second support devices 36 are formed symmetrically to longitudinal axis 11, which cooperate with first support devices 31. Between the first 31 and the second 36 support devices, a damping element 39 is arranged, respectively. Also in this representation, the distance "a" between outer contour 19 at tool arrangement 15 and inner contour 20 of outer housing 12 is well recognizable. The main effective direction of both arrangements of first and second support devices 31 and 36 intersects longitudinal axis 11 at machine tool 10. The construction and mode of operation of the arrangements of first and second support devices 31 and 36 is described more closely in combination with FIG. 4, which shows an enlarged presentation of Detail IV.

FIG. 4 shows an enlarged representation of a section through an arrangement of first and second support devices 31 and 36 with a damping element 39 arranged in between.

First support device 31 is shaped in the form of a rotational symmetric recess, which comprises the shape of a hollow calotte in its end portion. Second support device 36 is shaped in the form of the rotational symmetric pin, which is accordingly formed calotte-shaped. Thereby, the diameters D1 and D2 of recess and pin as well as radiuses R1 and R2 of the hollow calotte and calotte-shaped areas of recess and pin engaging therein are coordinated in combination with the dimensions and the material properties of the damping element 39 arranged in between such that damping element 39 comprises a desired initial tension in every direction in which a support of forces F shall take place in an assembled condition. Thereby, forces—at least up to a certain amount—are transmitted through damping element 39 by a frictional connection, without the respective first and second support devices "blocking", i.e. without a positive connection between support devices 31 and 36 being formed. The range of effective direction of forces F, which the arrangement of first and second support devices 31 and 36 depicted in FIG. 4 can support with a power transmission element 39 arranged in between, is suggested by the arrows "F" in this representation.

This exemplary embodiment applies, in order to keep a minimum spacing a between outer contour 19 of electric drive unit 14 and tool arrangement 15 and inner contour 20 of outer housing 12, first and second support devices 31, 36, between which a damping element 39 is arranged. By the depicted set-up of handheld machine tool 10 the supporting forces are supported by means of the first and second support devices 31, 36 with respect to outer housing 12, wherein outer housing 12 is essentially to mechanically decoupled with respect to electric drive unit 14 and tool arrangement 15.

The invention claimed is:

1. A handheld oscillation machine tool comprising:

an outer housing extending along a longitudinal axis and having a gripping region which is provided for a hand of a user to engage and guide the handheld oscillation machine tool;

an electric drive unit accommodated in this outer housing and rotatively driving a driveshaft of the handheld oscillation machine tool, wherein an axis of rotation of the driveshaft either aligns parallel to a longitudinal axis of the outer housing or the axis of rotation coincides with the longitudinal axis of the outer housing; and an oscillation tool arrangement arranged within a first end portion of the outer housing; wherein:

the outer housing has a mass center arranged along the longitudinal axis in a section extending from a geometric center of the outer housing in a direction remote from the first end portion with respect to a length of the outer housing;

the outer housing has a defined inner contour, and the electric drive unit and the oscillation tool arrangement are fixed together as a rigidly connected unit having a defined outer contour at a minimum spacing from the defined inner contour;

for adherence of this minimum spacing first support devices are provided at the outer contour, and second support devices are provided at the inner contour in positions opposed to the first support devices, and the first and second support devices cooperate to keep the defined outer contour at this minimum spacing from the defined inner contour;

the electric drive unit and the oscillation tool arrangement are mechanically decoupled from the outer housing by damping elements captured by and between the first and second support devices;

at least one arrangement of first and second support devices with one of the damping elements captured therebetween is provided at the oscillation tool arrangement, and at least one arrangement of first and second support devices with another of the damping elements captured therebetween is provided at the electric drive unit; and two auxiliary masses are arranged in the outer housing.

2. The handheld oscillation machine tool according to claim 1, wherein at least one operation arrangement of the handheld oscillation machine tool is mechanically coupled to the outer housing.

3. The handheld oscillation machine tool according to claim 1, wherein at least one control arrangement of the handheld oscillation machine tool is mechanically coupled to the outer housing.

4. The handheld oscillation machine tool according to claim 1, wherein at least one supply arrangement of the handheld oscillation machine tool is mechanically coupled to the outer housing.

5. The handheld oscillation machine tool according to one of claims 2 to 4, wherein the at least one operation arrangement, and/or at least one control arrangement, and/or at least one supply arrangement is mechanically decoupled from the electric drive unit.

6. The handheld oscillation machine tool according to claim 1, wherein at least one auxiliary mass is arranged in the outer housing.

7. The handheld oscillation machine tool according to claim 1, wherein a mass center of the outer housing is—with respect to a total length of the outer housing—arranged at a portion which extends into a direction remote from the first end portion of the outer housing as far as a distance that corresponds to 20% of the total length of the outer housing.

8. The handheld oscillation machine tool according to claim 1, wherein the mass center of the outer housing is arranged at a distance of approximately 15 mm from the geometric center of the outer housing in a direction remote from the first end portion.

* * * * *